US007690311B1

(12) United States Patent
Cronemberger

(10) Patent No.: US 7,690,311 B1
(45) Date of Patent: Apr. 6, 2010

(54) NON-LETHAL PROJECTILE WITH FLOWABLE PAYLOAD

(76) Inventor: Pedro de Oliveira Cronemberger, Rua Barão de Itambi, No. 34, apto. 1303, Botafogo, Rio de Janeiro, RJ (BR) 22231-000

( * ) Notice: Subject to any disclaimer, the term of this patent is extended or adjusted under 35 U.S.C. 154(b) by 85 days.

(21) Appl. No.: 12/247,218

(22) Filed: Oct. 7, 2008

(51) Int. Cl.
*F42B 10/00* (2006.01)

(52) U.S. Cl. ..... 102/502; 102/512; 102/513

(58) Field of Classification Search ..... 102/502, 102/503, 512, 517, 247, 513
See application file for complete search history.

(56) References Cited

U.S. PATENT DOCUMENTS 3,345,948 A * 10/1967 Sarvis ..... 102/513
3,776,137 A * 12/1973 Abbott ..... 102/431
5,009,164 A * 4/1991 Grinberg ..... 102/502
5,009,165 A * 4/1991 Morris ..... 102/513
5,035,183 A 7/1991 Luxton
5,388,524 A * 2/1995 Strandli et al. ..... 102/529
7,278,358 B2 5/2004 Huffman
7,143,699 B2 12/2006 Brock et al.
7,194,960 B2 3/2007 Vasel et al.

* cited by examiner

*Primary Examiner*—J. Woodrow Eldred

(57) ABSTRACT

A non-lethal projectile consisting of a solid capsule filled with a flowable payload. The solid capsule comprises a weakened area that ruptures upon impact with a target. The solid capsule also comprises an internal hydrodynamic structure. At the moment of impact, the internal hydrodynamic structure forces the radial movement of the flowable payload, from the center to the periphery, against the weakened area of the solid capsule, facilitating the rupture and reducing the pressure of projectile's point over target's surface.

8 Claims, 3 Drawing Sheets

NON-LETHAL PROJECTILE WITH FLOWABLE PAYLOAD

BACKGROUND OF THE INVENTION

The present invention relates to non-lethal projectiles that are filled with a flowable payload and designed to rupture upon impact with a target.

Non-lethal projectiles containing a flowable payload are basically used in three fields: the field of non-lethal kinetic energy projectiles, the field of non-lethal chemical projectiles and the field of marker projectiles.

Some projectile geometries were already proposed, trying to overcome simultaneously the following major problems:

a) keep the projectile's integrity during the feeding and firing procedures;

b) be stable in flight, hitting nose first;

c) rupture upon impact, causing controlled damage to the target.

In the field of non-lethal chemical projectiles, the U.S. Pat. No. 7,194,960 B2 describes a frangible projectile that ruptures upon impact, omnidirectionally dispersing an inhibiting powder payload. The impact creates a cloud of inhibiting powder substance over the target.

In the field of marker projectiles, U.S. Pat. No. 7,278,358 B2 describes a marking projectile comprising an outer casing that unseals upon impact, allowing the marking payload to flow forward via inertial effect.

Applicable in the three fields, it is known the U.S. Pat. No. 5,035,183, which describes a projectile with flowable payload that is built in two parts: a soft cap and a stronger base witch plugs the reward end of the cap. Longitudinal grooves and a thinned nose extremity facilitate the rupture upon impact.

Another patent applicable in the three fields is U.S. Pat. No. 5,009,164, of a non-penetrating projectile with flowable payload. The projectile contains a plurality of stress concentrator points which fracture, collapsing the whole projectile's structure when it hits a target.

It's also known the U.S. Pat. No. 7,143,699 B2 of a liquid filled projectile that have a two parts rupturing mechanism: a nose cap with a plurality of slits that open upon impact, and an obturating disc that keeps a flowable payload encapsulated and ruptures allowing the payload to flow through the opened slits of the nose cap.

In the three fields, what is expected from these projectiles is to have, at the same time, an external ballistics closer as possible to common lead core projectiles and an impact that do not cause lethal damages to the target. It means that these projectiles must combine a high maximum effective range with acceptable impact energy and almost zero penetration in living targets.

BRIEF SUMMARY OF THE INVENTION

The present invention is a non-lethal projectile, to be launched by a firearm or the like, consisting of a solid capsule that is filled with a flowable payload and designed to rupture upon impact with a target.

When a projectile filled with a flowable payload hits a target, the payload is strongly pushed in the direction of projectile's point by action of inertia. This effect creates in the payload an instantaneous pressure distribution that has its maximum value toward projectile's point. In the present invention, the capsular area closer to the point is specially weakened. This weakened area placed exactly where the pressure has a maximum value makes the rupturing faster, avoiding the projectile to impart too much energy to the target before the capsule collapses.

The projectile of the present invention also contains an internal, axially placed hydrodynamic structure. This hydrodynamic structure consists of a solid of revolution that is equal or similar to a cone. The extremity of this cone-like solid is oppositely oriented in relation to the projectile's point, as shown in FIG. 2. The extremity of this solid may also join an axial column, constituting a single body, as shown in FIG. 3.

Upon impact, the internal hydrodynamic structure forces a radial movement of the flowable payload, from the center to the periphery, against the weakened area of the capsule wall, as shown in FIG. 1. This weakened area ruptures by the action of payload's overpressure, allowing the payload to spread radially. This forced radial flow causes two desirable effects.

First, this flow represents a deflection of momentum. It means that the projectile's payload momentum will be smoothly deflected radially, by a hydrodynamic shaped structure. The consequence of this momentum deflection is a less concentrated impact energy and a lower pressure over target's surface.

Second, this forcing against the weakened area makes the complete rupture easier. Together with the inertial effect, this directional forcing of the flow helps the projectile's point not to pressure the target's surface too much long before the weakened area collapses.

This reduction in the impact pressure allows the projectile to hit the target at higher velocities, causing acceptable damages. This way, it is possible to impart a higher initial velocity to the projectile, obtaining a higher maximum effective range and precision.

When the chosen flowable payload is a high density fluid, for example a liquid alloy of Gallium, Indium and Tin (density approximately 6.4 times greater than water at room temperature) or Mercury (density approximately 13.5 times greater than water at room temperature), the energy carried by the projectile can be enough to temporally incapacitate an aggressor. The projectile will transfer this great amount of energy to a human target trough the impact of a mass that is mostly fluid, with a projectile geometry designed not to penetrate. It means that the aggressor will be stopped, but not killed.

The use a high density flowable payload brings two major advantages: first, the total weight of the projectile approximates to the weight of a lead-core common projectile, allowing the projectile to have range and precision performances closer to lethal ammunitions. Second, this high density increases the payload's portion in the projectile weight distribution, turning the impact of the projectile more similar to the impact of a whole fluid mass.

When the chosen payload is a non-lethal incapacitating agent or a dye, these benefits of high density doesn't exist. However, the payload has a volume that is much larger than the volume of the solid capsule. Thus, the total mass of any kind of flowable payload should be much larger than mass of the solid capsule.

Most common non-lethal incapacitating agents are tear gases (which include CS, CR and CN) and capsaicin compounds, commonly known as pepper spray. These agents produce temporary physiological or mental effects, or both, which will render individuals incapable of concerted effort in the performance of their assigned duties.

Both non-lethal chemical and non-lethal kinetic energy impact projectiles are designed to temporally incapacitate living targets, not killing them. It allows these kinds of projectiles to be used in hostage rescue operations, where standard lethal force can cause collateral damages to the hostages. In counter-terrorism operations it is preferable to use a non-lethal projectile to defeat and capture a suspect than to kill him. Crowd control operations are also another field of use of these non-lethal projectiles.

When the projectile's purpose is to be non-lethal chemical or non-lethal kinetic energy impact, larger calibers may be preferable, because a larger projectile can hold a larger mass of payload. Calibers typically used for this application are 40 mm, 37 mm, 0.68 inches and 12 gauge.

The projectile of the present invention can be launched by any firearm or the like. When the payload is a dye, any service firearm adapted to fire marker cartridges may be used. This adaptation may include a system to block the chambering of a lethal cartridge. Marker projectile are commonly used in simulation and training systems.

Common cartridges comprises, besides the projectile, a case filled with propellant and a primer. Some cartridge configurations also include a sabot. A sabot is a device used in firearms to fire a projectile whose diameter is smaller than the gun bore diameter. The projectile of the present invention can be fired by a cartridge using or not a sabot.

Non-lethal projectiles are usually fired using small amounts of propellant, by cartridges that have high-low pressure propulsion systems. These systems comprise, inside the cartridge case, a high pressure chamber connected to a low pressure chamber. This configuration ensures a high burning pressure to a small amount of propellant, increasing its performance. The projectile of the present invention is able to be fired by a high-low pressure propulsion system.

The objects of the present invention are:

1) A non-lethal kinetic energy impact projectile, when the payload is a high density fluid.
2) A non-lethal chemical projectile, when the payload is a non-lethal incapacitating agent.
3) A marker projectile, when the payload is a dye.

DETAILED DESCRIPTION OF THE INVENTION

Figure 1:
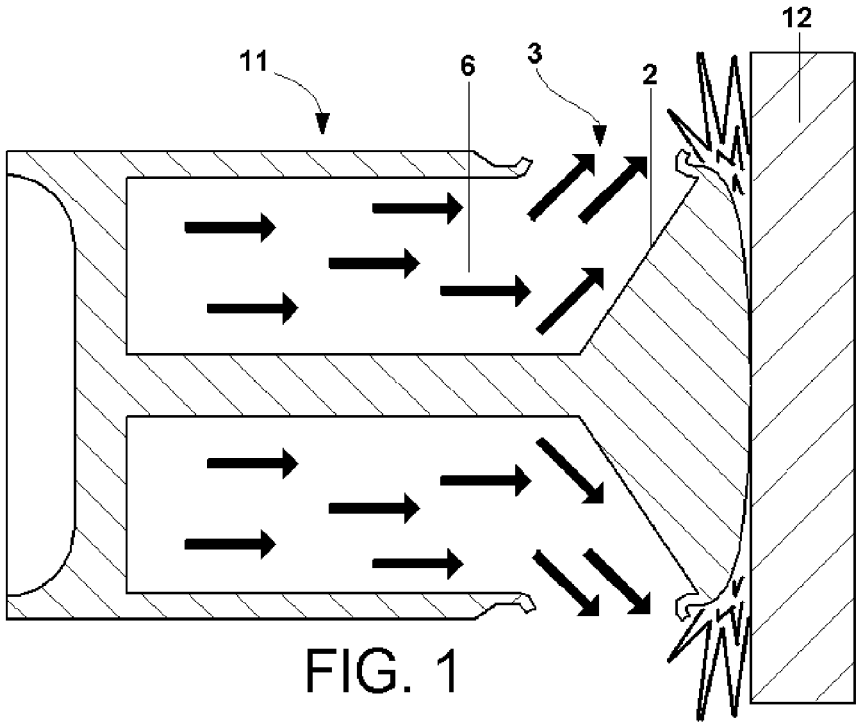
FIG. 1 is a cross sectional view of the projectile at the moment of impact, showing the flow of the payload.

As can be seen in FIG. 1, the projectile of this invention consists of a solid capsule (11) that is filled by a flowable payload (6). When the projectile hits a target (12), the payload (6) is pushed forward by action of inertia. The inertial effect creates a pressure gradient with maximum value close to the point (1). By the effect of this pressure, the weakened area (3) ruptures, allowing the payload (6) to be radially spread out. A hydrodynamic structure (2) forces the radial flow of the payload (6), from the center to the periphery, against the weakened area (3).

The solid capsule (11) is made to be light weighted, using light structural materials, such as engineering plastics or aluminum alloys. Polyamides have been shown applicable. In opposite, the flowable payload (6) is selected to have the greater density, and consequently the greater total weight, as possible. However, this desirable high density shall not cause an elevation in viscosity that could harm the flowing capability of the payload (6). This weight distribution between the flowable payload (6) and the rest of the projectile reflects directly on the kinetic energy that each part carries. Thus, the greatest amount of the kinetic energy transferred to the target (12) goes through the impact of a flowable mass.

Figure 2:
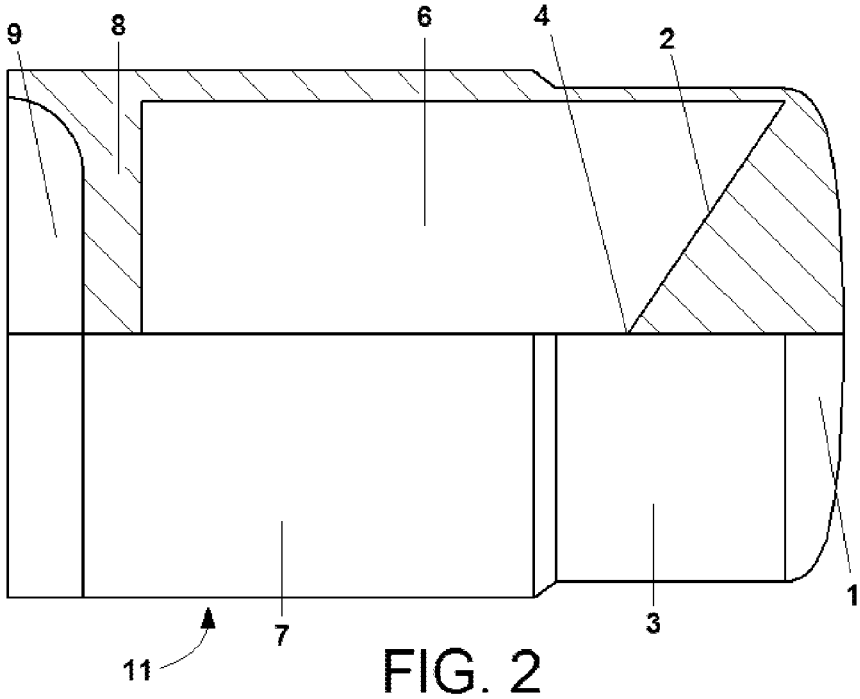
FIG. 2 is a partially broken away view of the projectile without column.
Figure 3:
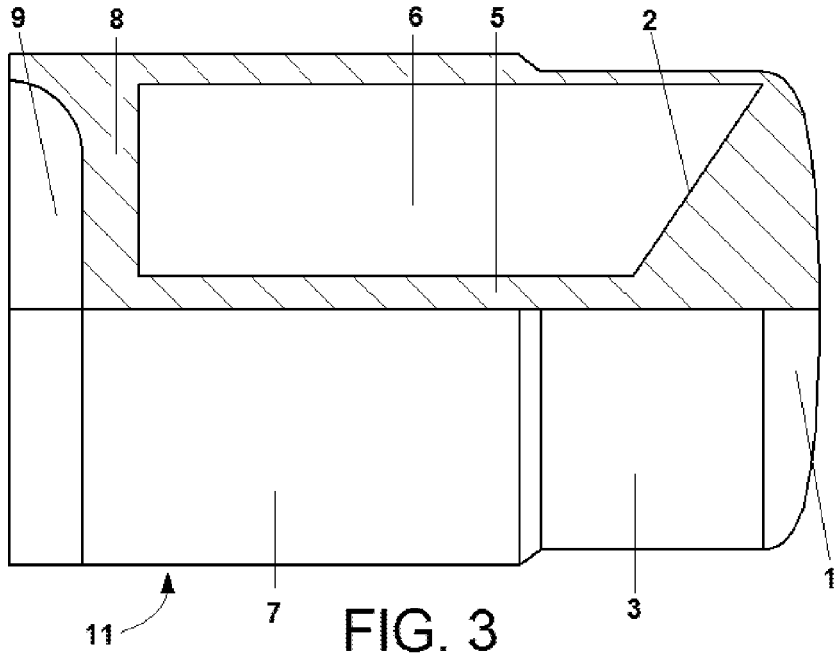
FIG. 3 is a partially broken away view of the projectile with column.

Referring now to FIGS. 2 and 3 of the drawings, the solid capsule (11) comprises a point (1) that may be rounded or flat; a hydrodynamic structure (2) that consists of a solid of revolution equal or similar to a cone and has an extremity (4) that is oppositely oriented in relation to the projectile's point (1); a weakened area (3) that is designed to rupture upon impact; a resistant area (7) that is stronger than weakened area (3) to resist the firing efforts; a base (8) that resists the firing propelling pressure and a base cavity (9) that pushes the projectile's center of gravity to the point's (1) direction, increasing ballistic stability. In the embodiment of FIG. 3, it is shown a column (5) that helps to keep the solid capsule (11) structural integrity. This column (5) is axially placed and suppresses the extremity (4) of the hydrodynamic structure (2).

Figure 4:
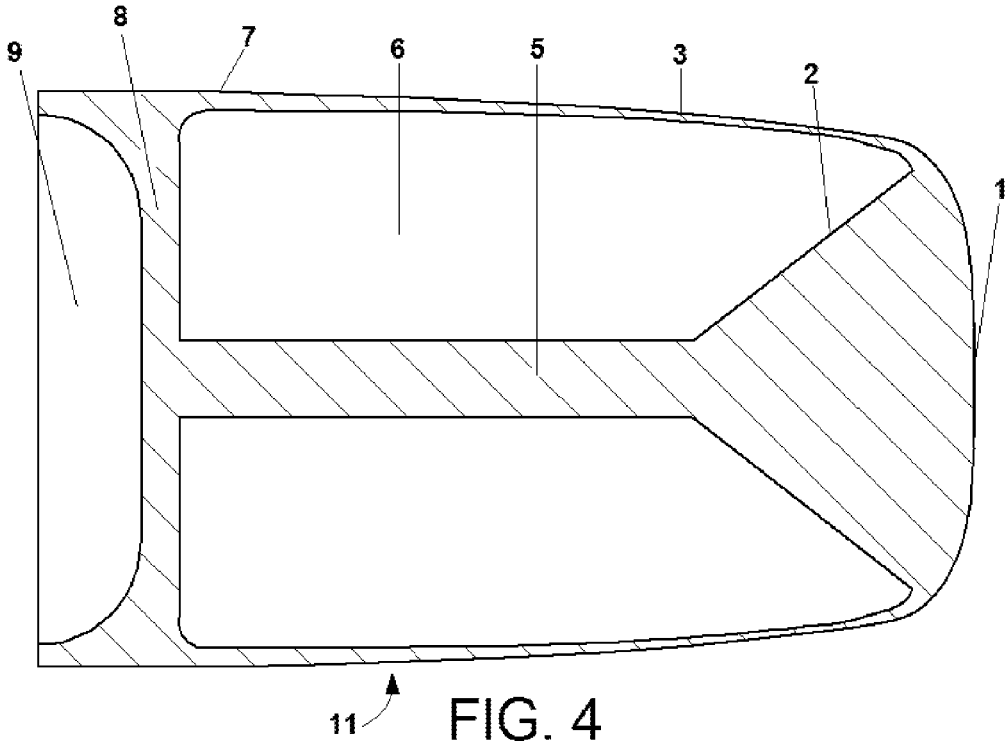
FIG. 4 is a cross sectional view of the projectile with an aerodynamic external shape.

Referring now to FIGS. 2, 3 and 4, the resistant area (7) is placed close to the base (8) and is characterized by having a larger diameter and a thicker wall than the weakened area (3). The projectile engages with the gun barrel's rifling grooves through the resistant area (7). The resistant area (7) may also be attached to a sabot. A sabot is a device used in a firearm to fire a projectile whose diameter is smaller than the gun bore diameter.

Figure 6:
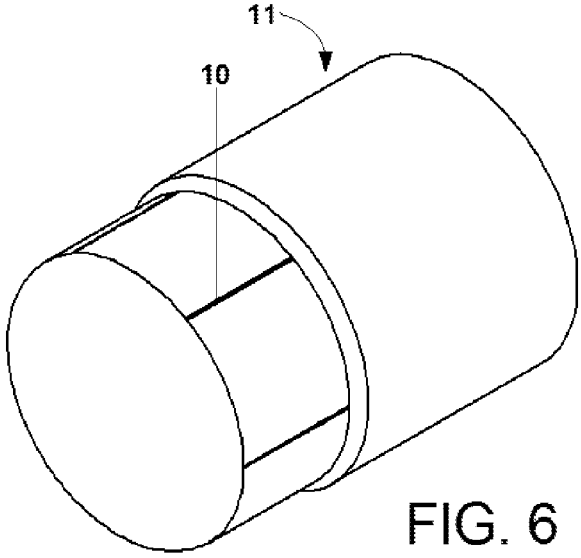
FIG. 6 is a perspective view of the projectile with the weakened area having grooves.

The weakened area (3) is placed close to the point (1), and has a smaller diameter than the resistant area (7). Thus, when the projectile is fired, the weakened area (3) doesn't engage the gun barrel's rifling grooves. The weakened area (3) is also characterized by its frangibility. This frangibility may be obtained by constructing the weakened area (3) with a thinner wall, as show in FIGS. 2, 3 and 4. A weaker material may be used to construct this area, obtaining the same desirable frangibility. Also, the frangibility of the weakened area (3) may be obtained by using stress concentrators. An example of stress concentrator, which is observed in FIG. 6, is longitudinal grooves (10). These grooves (10) have a wall thickness even smaller than the rest if the weakened area (3) and concentrates the stress caused by payload's pressure to facilitate the rupture.

The solid capsule (11) is made to be light weighted, thus is the hydrodynamic structure (2), as part of the solid capsule (11), is light weighted too. Consequently, the hydrodynamic structure (2), which is placed adjacent to the point (1), pushes the projectile's center of gravity to the base's (8) direction, harming ballistic stability. This is the reason why a cavity (9) shall be placed adjacent to projectile's base (8). This cavity (9) pushes the projectile's center of gravity to the point's (1) direction, compensating the negative effect of the hydrodynamic structure (2) in ballistic stability. Another way to compensate the destabilizing effect of hydrodynamic structure (2) is imparting a greater spin to the projectile. This spin increase is obtained by modifying the rate of twist of the gun barrel's rifling grooves. A further way to compensate said destabilizing effect is placing aerodynamic fins on the base (8) of the projectile.

Referring now to FIG. 3, a solid capsule (11), which is made to be light weighted, will probably have a thin and vulnerable capsular structure. This structural vulnerability may be overcome by placing a structural column (5) inside the solid capsule (11). This structural column (5) is axially placed and helps the solid capsule (11) to keep its integrity against feeding and firing efforts.

Major efforts of firing are caused by abrupt acceleration, high pressure and temperature of the propellant gases and the effort of engaging with the gun barrel's rifling grooves. The resistant area (7) and the base (8) are the most affected by efforts of firing. Thus, these areas must have a reinforced wall. This reinforcement can be obtained with a thicker wall, as shown in the FIGS. 2, 3 and 4. Structural plastics, like polyamides or aluminum alloys are the most appropriated materials to construct these areas, due to its combination of mechanical resistance with light weight.

The projectile's point (1), the hydrodynamic structure (2) and the column (5) may be built in a softer material, to minimize more the impact penetration. Elastomers like synthetic rubber and polyurethane have been shown applicable.

The whole solid capsule (11) may be built in a single material. In this case, the frangibility of the weakened area (3) and the resistance of the base (8) and the resistant area (7) shall be obtained by manipulating the wall thickness of these areas or using longitudinal grooves (10) on the weakened area (3). When the whole solid capsule (11) is built in a single material, injection molding can be used to manufacture it. When the solid capsule (11) is made of a plurality of materials, adhesives can be used to put different parts together. Plastic welding is also applicable in both cases.

Figure 5:
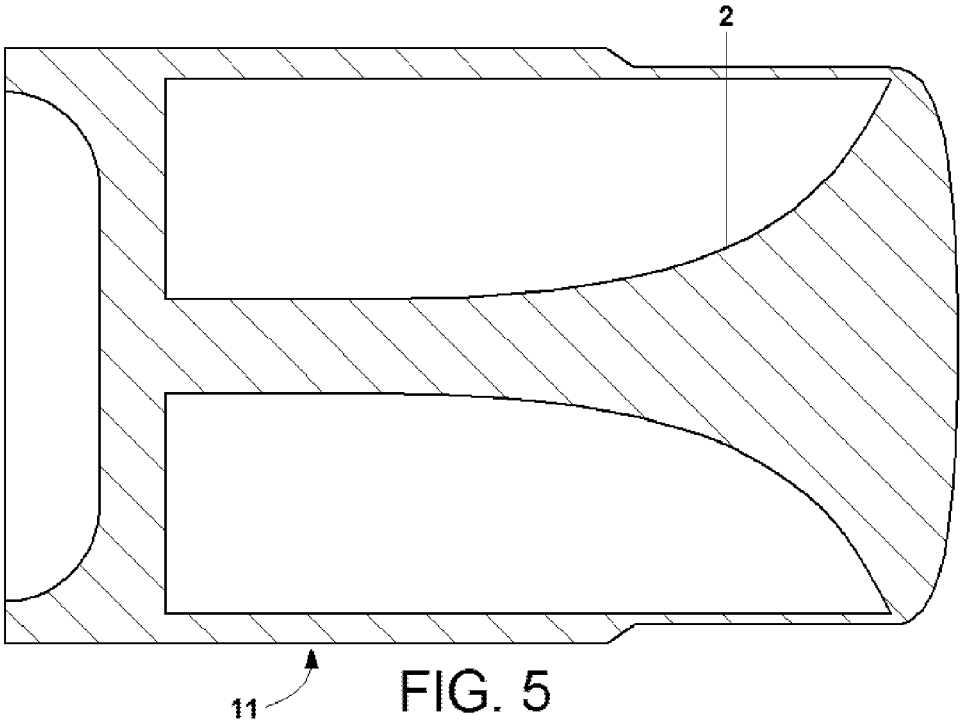
FIG. 5 is a cross sectional view of the projectile with an internal hydrodynamic structure that is a solid of revolution with a concave profile.

The hydrodynamic structure (2) may have a shape that is similar to a cone, but not perfectly conical. The embodiment of FIG. 5 shows a hydrodynamic structure (2) that is a solid of revolution with a concave profile. Variations in the solid of revolution profile can affect the projectile's center of mass position and the capacity of the hydrodynamic structure (2) to radially deflect the flowable payload (6). This deflecting capacity relates directly to the impact pressure of projectiles point (1) over the target (12) surface.

The solid capsule (11) has a generally cylindrical external profile. In the embodiment of FIG. 4 it is shown a solid capsule (11) with an aerodynamically shaped external profile. In this embodiment, the transition between the weakened area (3) and the resistant area (7) is continuous.

I claim:

1. A projectile consisting of a solid capsule filled with a flowable payload, said solid capsule comprising:

a) a point that is the part of the solid capsule which is closer to the target at the moment of impact b) a single weakened area that is less resistant than the rest of the solid capsule, is located adjacent to the solid capsule's point, is the only part of the solid capsule which completely collapses upon impact, ruptures from inside to outside because of the payload's pressure at the moment of impact, the weakened area being one of material being thinner than the rest of the solid capsule, is made of less resistant material than the rest of the solid capsule, or has multiple grooves on it for stress concentration c) a base that keeps its shape upon impact and is the part of the solid capsule which is more distant to the target at the moment of impact d) an internal hydrodynamic structure, consisting of a cone that is coaxial to the projectile, is pointed in the opposite direction of the capsule's point, is immersed in direct contact with the payload, is made of a lighter or same density material in relation to the payload's density, has direct contact with all the flow of the payload at the moment of impact, and radially diverges from the center to the periphery this entire flow directly to a single weakened area e) a resistant area that is more resistant than the weakened area, is located adjacent to the solid capsule's base and keeps its shape upon impact.

2. The projectile of claim number 1, wherein said payload is a dye.

3. The projectile of claim number 1, wherein said payload is a high density fluid.

4. The projectile of claim number 1, wherein said payload is a non-lethal incapacitating agent.

5. The projectile of claim number 1, further comprising a column that is placed along the projectile axis, from the internal hydrodynamic structure to the capsule's base, and reinforces the solid capsule, preventing it from changing its shape upon the impact.

6. The projectile of claim number 5, wherein projectile's payload is a dye.

7. The projectile of claim number 5, wherein projectile's payload is a high density fluid.

8. The projectile of claim number 5, wherein projectile's payload is a non-lethal incapacitating agent.

* * * * *